United States Patent [19]

Wills et al.

[11] 4,308,795

[45] Jan. 5, 1982

[54] LOW ENERGY IMPACT PRINTER

[75] Inventors: David C. Wills, Cambridge; Raymond L. Lawter, Zanesville; Barry D. Briggs, New Concord; Edward F. Sampson, Cambridge, all of Ohio

[73] Assignee: NCR Corporation, Dayton, Ohio

[21] Appl. No.: 100,765

[22] Filed: Dec. 6, 1979

[51] Int. Cl.[3] ..... B41J 1/08

[52] U.S. Cl. ..... 101/93.37; 101/93.44

[58] Field of Search ..... 101/93.25, 93.37, 93.44, 101/93.45, 93.47; 235/60.41, 60.47, 60.51, 60.53

[56] References Cited

U.S. PATENT DOCUMENTS

| | | | |
|---|---|---|---|
| 1,863,098 | 6/1932 | Borel | 101/93.37 |
| 1,902,060 | 3/1933 | Dechene | 101/93.44 X |
| 3,241,756 | 3/1966 | Schenk | 101/93.37 X |
| 3,808,969 | 5/1974 | Pearce | 101/93.37 X |
| 3,839,957 | 10/1974 | Deleuze et al. | 101/93.37 |
| 3,916,786 | 11/1975 | Clary | 101/93.37 |

*Primary Examiner*—Edward M. Coven

*Attorney, Agent, or Firm*—J. T. Cavender; Wilbert Hawk, Jr.; George J. Muckenthaler

[57] ABSTRACT

The action of a rotatable cam assembly positions a plurality of type racks, enables printing and indexes paper prior to restoring the type racks to the home position. Teeth on the cam assembly engage teeth on the type racks for positioning thereof and an extended tooth on the cam assembly causes impact of the racks against a platen which is caused to be rotated by movement of the cam assembly to index the paper to the next print line.

20 Claims, 5 Drawing Figures

LOW ENERGY IMPACT PRINTER

BACKGROUND OF THE INVENTION

In the field of impact printers, certain design goals have included the concepts of low cost production along with low power consumption and low cost operation. A number of the previous impact printers used electromagnetic solenoids for moving certain parts of the printer such as the print hammers, however these solenoids consumed energy in amounts considered larger than necessary or economically feasible if lower costs were to be maintained.

Since impact printers commonly have included a platen with characters thereon for impact by the print hammers, the platen also required some type of drive means for positioning the platen for printing the proper characters at the exact instant in time. In the case of the very successful drum-type printer, the drum served as a platen and required a drive member or mechanism to rotate the drum at the desired speed. Additionally, the paper or like record media needed to be advanced after the completion of a line of printing.

Printing mechanisms have also included type racks carrying a plurality of type characters thereon and adapted to be positioned in one of a plurality of positions when printing takes place upon actuation of a printing element against the type character.

Representative prior art in the type character rack concept is U.S. Pat. No. 1,863,098, issued to C. Borel on June 14, 1932, and disclosing apparatus for computing statistical data which includes a cam on the drive shaft which raises a bar to enable release of the type elements to be driven to printing position. Type hammers impact the type elements against the paper and against a platen, and electromagnets are energized to attract and release the armatures for permitting movement of the type elements.

U.S. Pat. No. 1,902,060, issued to P. Dechene on Mar. 21, 1933, discloses printing mechanism with certain members biased upwardly by springs against a locking pawl. A rack member meshes with a gear which is pivoted to a lever biased by a spring and another gear carries a disc with type indicia thereon. A magnet releases the locking pawl to permit travel of the rack members upward and latch the gear to position the type indicia relative to the platen.

U.S. Pat. No. 3,241,756, issued to G. Schenk on Mar. 22, 1966, discloses printing mechanism for calculating machines having pinions meshing with teeth of type bars which include type faces thereon. A slide member is shiftable along the type bars, and a plate portion thereof has a hub and a ramp engageable against a rod when the type bars are in a raised position. The type hammers are immediately rotated to cam the type bars against the platen.

SUMMARY OF THE INVENTION

The present invention relates to impact printers and more particularly to a printer designed with the idea of providing a low power consumption printing mechanism at low cost. The printer includes a plurality of type racks with one rack assigned to each print column and each rack having a plurality of type characters molded on one face of the rack and a set of teeth on the opposite face of the rack and designed to engage and disengage mating teeth on a rotary-driven teeth and cam member. One of the teeth on the cam member is longer than the other teeth to cause the type racks to be moved toward the platen at a precise time during the cycle of operation.

The cam member is sensed by a timing wheel and photosensor arrangement and the teeth on the cam member are designed to index each print rack to the respective print position and to apply the force necessary for printing and also to index the paper in accordance with an oscillating or rotary-moving platen, after which the racks are disengaged from the teeth on the cam member to allow the racks to return to a rest position and to be latched in that position. The latched position is maintained by a permanent magnet on each rack and acting with the core of an associated electromagnet. The individual type racks are released to be moved in the upward direction at precise times and one revolution of the cam member engages the respective type racks to align the correct type character with the platen and to cause printing when the longer tooth on the cam member moves the respective type rack into engagement with the paper in contact with the platen.

In view of the above discussion, the principal object of the present invention is to provide a printing mechanism which permits lower power consumption for operation.

An additional object of the present invention is to provide a compact printer which enables low power supply for operation.

Another object of the present invention is to provide an impact printer which utilizes a teeth and cam member for a plurality of functions.

A further object of the present invention is to provide a cam member having a toothed profile for indexing type characters for applying the printing force and for causing advancement of the paper or other record media.

Additional advantages and features of the present invention will become apparent and fully understood from a reading of the following specification taken together with the annexed drawing.

DESCRIPTION OF THE PREFERRED EMBODIMENT

Figure 1:
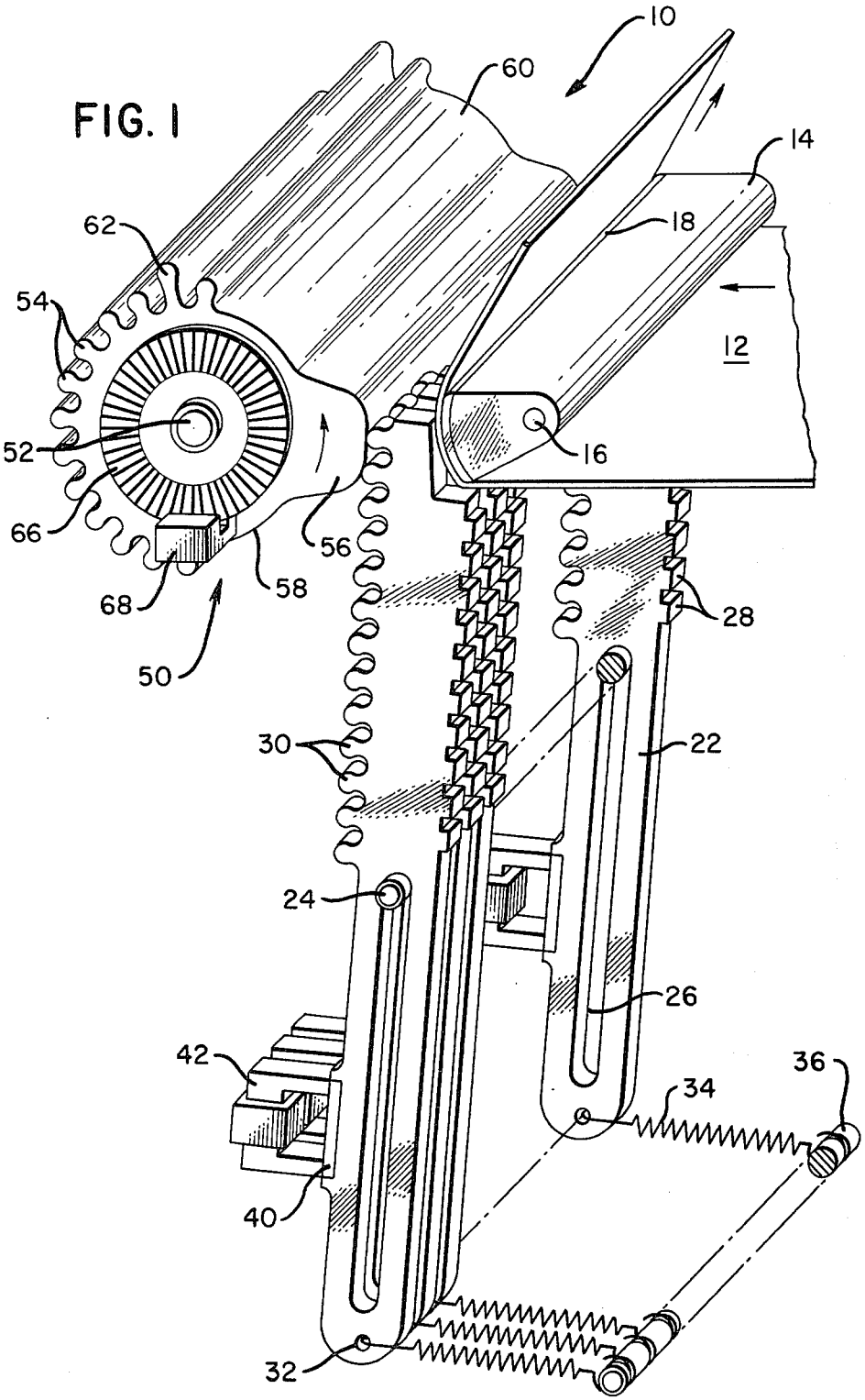
FIG. 1 is a view of an impact printer incorporating the subject matter of the present invention.

Referring now to FIG. 1 there is shown an isometric view of a portion of a printer generally designated as 10 wherein paper or like record media 12 is positioned in a path toward and trained around a platen 14. The paper 12 is caused to be moved or advanced in the direction of the arrows. The platen 14 is supported from and pivotally carried on a shaft 16 journaled in suitable manner from side frames (not shown) so as to enable oscillation or limited rotary movement of the platen during a printing operation. Such platen 14 includes a printing surface 18 of material commonly used for impact printers of the type wherein type character impressions are made on the paper 12 as a result of impacting the type characters against the paper and against the platen.

A plurality of type racks 22 are disposed generally in a vertical direction and positioned downwardly and adjacent the platen 14. Such type racks 22 are supported from and pivotally carried on a pin or shaft 24 journaled in suitable manner from side frames (not shown). The type racks 22 which may typically be ten or twelve in number are closely spaced on the pivot pin 24 to allow sufficient clearance between the racks and are spaced to permit freedom of movement of each of the racks in an up and down direction. Each of the racks 22 includes an elongated slot 26 therein for enabling travel along the pivot pin 24 as the racks are moved in an up and down direction during the printing operation. Each of the racks 22 also has a plurality of spaced type characters 28 on one face thereof adjacent the platen 14 and a plurality of teeth 30 on the opposite face thereof. Additionally, each of the racks 22 has an aperture 32 at the lower end thereof for connecting with one end of spring 34 which has the other end thereof connected to a pin or rod 36 which is fixed or otherwise secured in suitable manner to the frame of the printer 10.

Each of the type racks 22 also includes a permanent magnet 40 on the face opposite that face with the type characters 28, the magnet 40 being positioned near the lower portion of the slot 26. An electromagnet assembly comprising an electromagent 42 for each of the type racks 22 is disposed adjacent the permanent magnet 40 of each type rack 22 for holding the respective rack in a home or latched position.

An elongated cam assembly generally designated as 50 is supported from and pivotally carried on a shaft 52 journaled in suitable manner from the side frames of the printer 10. Such cam assembly 50 has a plurality of teeth 54 extending across the width thereof and corresponding in size and shape to mesh with the teeth 30 on the type racks 22. The cam teeth 54 occupy more than half of the circumference of the cam assembly 50 while an extended radial portion or lobe 56 thereof is formed with circumferential surface portions 58 and 60 to meet with the teeth 54. The cam assembly 50 also includes one extended tooth 62 which is located as the second last tooth for engaging with the teeth 30 of the type racks 22 and for moving the racks 22 into engagement with the paper 12 and against the platen 14 for printing the respective characters 28 then positioned along the line of printing.

The cam assembly 50 additionally carries a timing plate or wheel 66 having indicia thereon and a photo sensor 68 for initiating signals indicating the position of the cam assembly. The signals thus sensed are transmitted to appropriate control mechanism (not shown).

Figure 2:
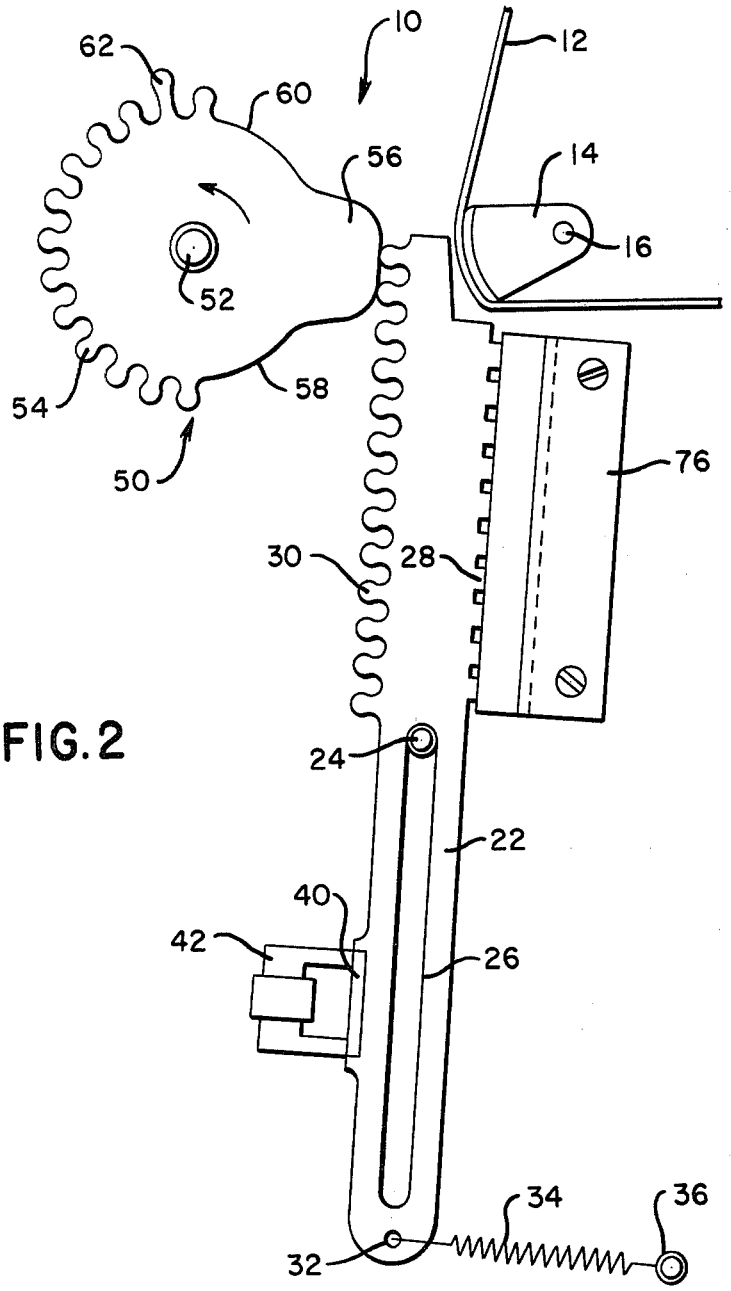
FIG. 2 is a side elevational view showing the type racks in the home position.

An ink pad 76 (FIGS. 2–5) is secured to the frame of the printer 10 and is so disposed to be contacted by the type characters 28 for inking thereof when the type racks 22 are in the home or latched position (FIG. 2).

During printer operation, the cam assembly 50 is effective to index each print rack 22 to the desired or proper print position, to apply printing force for printing the desired characters 28, to index the paper 12 by rotating the platen 14, to disengage the racks 22 to allow their return to the rest or home position by means of the springs 34 and to restore the type racks 22 to their latched position.

FIG. 2 shows the type racks 22 in a home position or idle mode after restoring by the cam assembly 50 and latched by reason of the attraction of the permanent magnets 40 to the electromagnets 42. At such time, the type racks 22 are seated on the pin 24 with the upper portion of each type rack being displaced from the platen 14 and with the radially-extending lobe portion 56 of the cam assembly 50 being in engagement with the upper teeth 30 of the type racks 22 and the type characters 28 being in contact with the ink pad 76.

Figure 3:
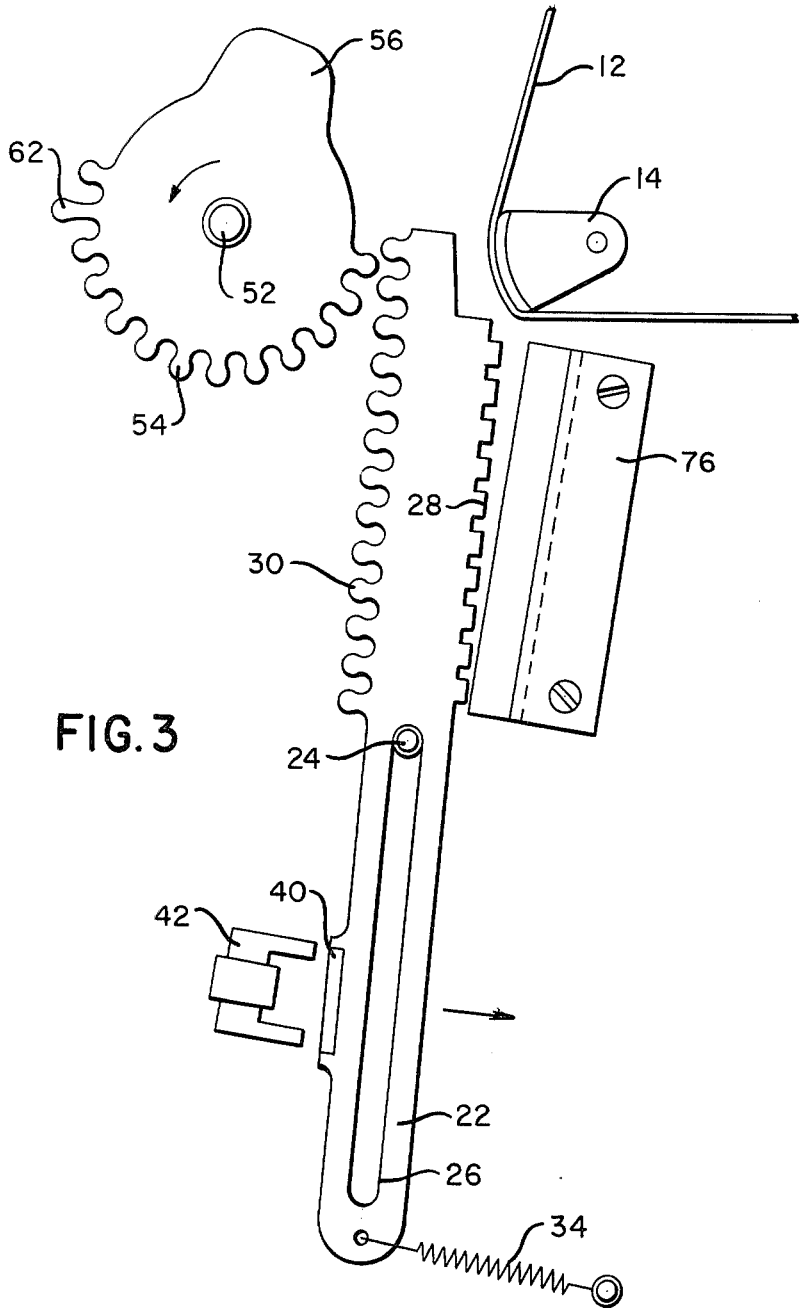
FIG. 3 is a side elevational view showing the relationship of the type racks and the cam member at the start of a printing cycle.
Figure 4:
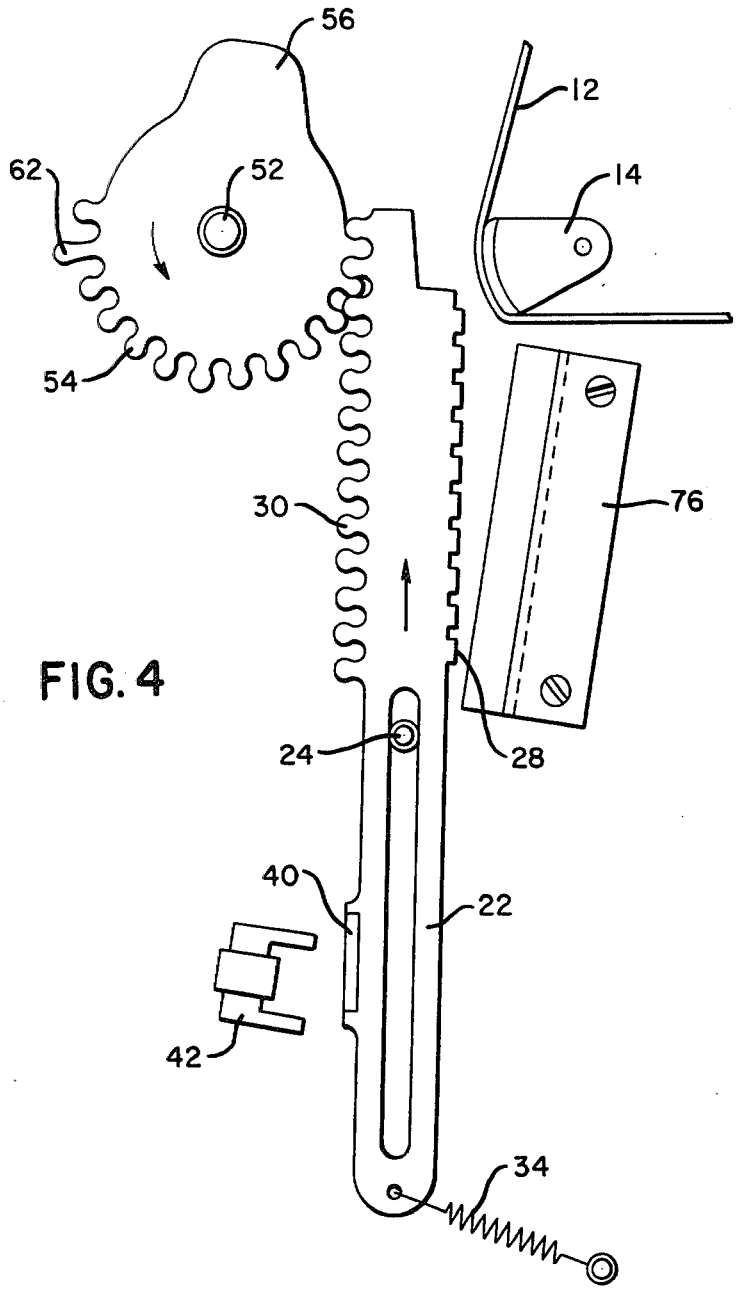
FIG. 4 is a side elevational view showing the cam member rotated into engagement with the released type rack.

The beginning of a print cycle is shown in FIG. 3, wherein the electromagnet 42 of a type rack 22 selected for performing a printing function has been energized to repel the permanent magnet 40 and to allow the spring 34 to pivot the type rack 22 on the pin 24 in a counterclockwise direction for moving the type characters 28 thereof away from the ink pad 76 and for moving the teeth 30 thereof toward engagement with the teeth 54 of the cam assembly 50. The next portion of the print cycle is illustrated in FIG. 4, wherein the teeth 30 of the type rack 22 are engaged with teeth 54 of the cam assembly 50 during rotation of the cam assembly for driving the type rack 22 in the upward direction.

Figure 5:
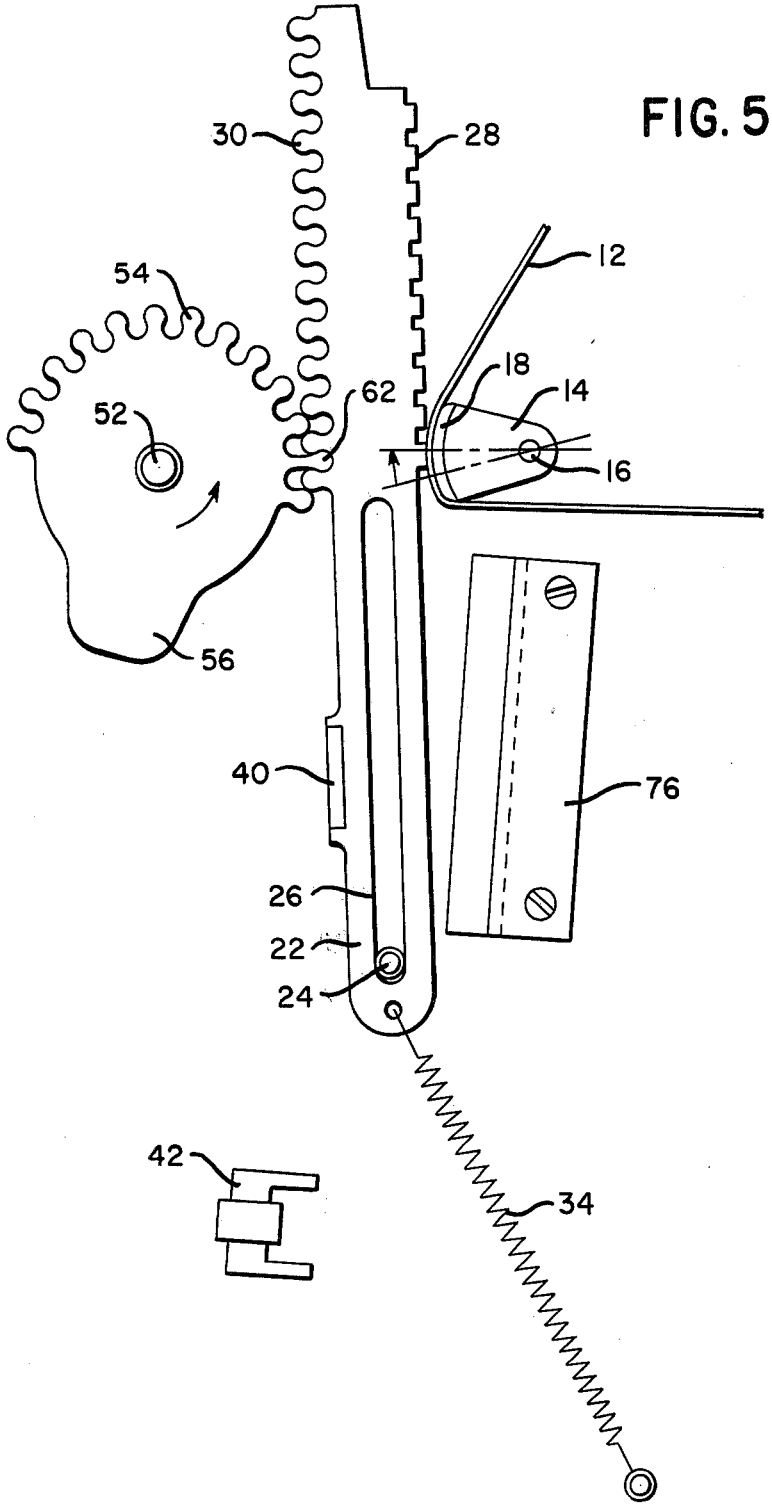
FIG. 5 is a side elevational view showing the cam member rotated into position with the print tooth engaging the type rack and printing the desired type character.

The printing portion of the print cycle is shown in FIG. 5, wherein the teeth 54 of the cam assembly 50 have been in engagement with teeth 30 of the type rack 22 to drive the type rack upward to position the desired or proper type character 28 on the rack adjacent the platen 14 and the cam assembly 50 has rotated sufficiently in a counterclockwise direction to cause the print tooth 62 thereof to engage the type rack 22 and force such rack clockwise and against the paper 12 and the platen 14 for printing the aligned character 28. During the printing operation of the character on the paper, the upward movement of the type racks 22 rotates the platen 14 a predetermined amount to advance the paper 12 as shown by the angular rotation of the platen (FIG. 5), and as described hereinafter.

In the operation of the printer 10, the type racks 22 are initially in the home or rest position and are latched by reason of the attraction between the electromagnet 42 and the permanent magnet 40 on each rack. A print cycle is initiated by selectively pulsing the electromagnets 42 to oppose the respective permanent magnets 40 on those print racks 22 selected for operation and thereby release such racks 22 to permit engagement of the teeth 30 thereon with the teeth 54 of the cam assembly 50 under the control or force of the associated springs 34. One or more of the type racks 22 associated with non-selected columns, of course, are not actuated and remain in the latched position for a particular printing cycle. The correct line of printing is set by first releasing the rack or racks 22 which must print the character which is farthest or most remote from the platen 14 in the latched position. The release of the respective print racks 22 is timed so that the teeth 30 on each print rack will engage the correct teeth 54 on the cam assembly 50 to cause the desired character 28 thereon to be moved into position at the face of the platen 14 at the precise instant that the print tooth 62 of the cam assembly 50 engages the rack 22 for impacting same against the paper 12 and the platen 14.

The remaining racks 22 are thus released in time relationship to the first rack or racks released so that the correct character 28 for each rack and thereby for each column is aligned with the first character or column that was released. Since the type racks 22 are released in timed relationship, the selected characters 28 for all columns to be printed will be moved simultaneously toward the platen 14 for printing these characters along a line of printing. At this point in time, the print tooth 62 on the cam assembly 50 engages the type racks 22 and causes all the type racks selected for operation to pivot on the pin 24 and move against the platen 14 so that the paper 12 is compressed between the respective characters 28 aligned across the printing station and the platen 14 in the printing operation whereby the ink presented to the type characters 28 by the ink pad 76 is transferred from such characters 28 onto the paper 12.

The assembly of type racks 22 continues to move when in contact with the platen 14 and such movement causes the platen 14 to pivot or rotate a precise amount in the clockwise direction (arrow of FIG. 5) to pull or advance the paper 12 forward and upward an amount to index same the proper distance for printing on the next line. The paper is indexed the precise amount during the last portion of the printing operation and continued upward movement of the type racks 22 is by engagement of the last tooth 54 with the particular tooth 30 on each rack.

At the end of the printing portion of the print cycle, the last tooth 54 on the cam assembly 50 disengages from the teeth 30 on the print racks 22 and such racks are returned downwardly to home or rest position by the action of the springs 34. During such time, the cam assembly 50 is rotated from the last tooth 54 to the lobe portion 56 while the type racks 22 are returned to such home position. Then the extended radial portion or lobe 56 of the cam assembly 50, upon reaching the proper position of counterclockwise rotation, becomes effective to drive the racks 22 to the latched position where the characters 28 on the racks again contact the ink pad 76 and the racks are held in place by the permanent magnets 40 being attracted to the electromagnets 42, as shown in FIG. 2.

It is of course understood that the paper 12 may be indexed or advanced without printing of characters by means of a dummy character or index bump or the like being provided on the print rack 22 and of such configuration or size to be not in position for inking thereof by the ink pad 76. For one example, the two end racks 22 can be utilized and engaged by the cam assembly 50 so that dummy character or index bumps thereon are driven to the line of printing to cause advancing of the paper 12 by a distance of one line without printing any characters. The printing can be advanced or indexed a plurality of lines by repeating the above cycle. Additionally, during the printing cycle, if no character is to be printed in the end columns, the dummy characters can be used to prevent paper skew when printing occurs at only one end of the print line.

Certain variations of the instant printer 10 may include the use of an ink roller in contact with the type characters 28 rather than the ink pad 76. An ink ribbon may also be used, but if so done it is important that the dummy character or bumps on the type racks 22 contact the paper away from or off of the ribbon so as to accomplish paper feed without printing.

The type racks 22 as described above are preferably made of a thermoplastic material by means of an injection molded process. Alternatively, such racks may be made of a non-ferrous metal. Another variation may include elimination of the ink pad 76 or like means altogether by making use of porous ink filled and replaceable type strips which are secured to the type racks.

The cam assembly 50 may be injection molded or extruded thermoplastic or it may even be made of powdered metal. The extruded plastic or the powdered metal cam assembly are not as susceptible to draft problems as may be the injection molded plastic.

Additionally, while the described electromagnet structure 42 covers a single assembly of electromagnets to control the release of the print racks, dual assemblies acting on alternate print racks may be more feasible by reason of space limitation between the type racks.

It is thus seen that herein shown and described is a low cost and energy impact printer allowing the use of a smaller power supply or even permit battery operation. The printing is accomplished by means of cam action and the print elements are restored by spring and cam action with permanent magnets being utilized for latching the print elements in the home position. The impact printer enables the accomplishment of the objects and advantages mentioned above, and while a preferred embodiment of the invention has been disclosed herein, variations thereof may occur to those skilled in the art. It is thus contemplated that all variations and modifications not departing from the spirit and scope of the invention hereof are to be construed in accordance with the following claims.

We claim:

1. An impact printer comprising a platen member, a plurality of type character bearing members positionable in relation to said platen member for printing along a line of printing, a unitary member sequentially engageable with said type character bearing members and having a unitary member portion engageable with said bearing members for moving said bearing members from a home position into a printing position adjacent said platen member for enabling printing along said line of printing, said unitary member having another portion engageable with said type character bearing members for moving said bearing members toward and into contact with said platen member for printing, said unitary member being disengageable from said type character bearing members for permitting movement of said bearing members toward said home position, and means for moving said type character bearing members toward said home position from said printing position, said unitary member having a further portion engageable with said type character bearing members for repositioning said bearing members in said home position.

2. The printer of claim 1 wherein said platen member is an elongated member pivotable for rotation by said type character bearing members to advance record media.

3. The printer of claim 1 wherein said type character bearing members are racks independently movable from a home position to a printing position.

4. The printer of claim 1 wherein said unitary member is a toothed member rotatable to engage with and to move said type character bearing members to the printing position.

5. The printer of claim 1 wherein said unitary member includes a toothed portion for engaging a mating portion of each of said type character bearing members for moving said type character bearing members to the printing position.

6. The printer of claim 1 wherein said type character bearing members are racks having type characters on one face thereof and a plurality of teeth on the opposite face for engagement by said unitary member.

7. The printer of claim 1 wherein said type character bearing members include a plurality of teeth and said unitary member includes a circumferential portion having a plurality of teeth engageable with the teeth of said type character bearing members for moving said members to the printing position.

8. The printer of claim 1 wherein said unitary member includes a plurality of teeth for moving said type character bearing members to the printing position and an extended portion for moving said type character bearing members against said platen member for printing.

9. The printer of claim 1 wherein said unitary member includes an enlarged cam portion engageable with said type character bearing members for repositioning said bearing in the home position.

10. The printer of claim 1 including magnetic means for latching said type character bearing members in the home position.

11. In a printer, a platen rotatable for enabling advancement of record media therearound, a plurality of type character bearing members movable in relation to the platen, a rotatable member adjacent said type character bearing members and sequentially engageable therewith and having a rotatable member portion engageable with said bearing members for moving said bearing members from a non-printing position to a printing position adjacent said platen, said rotatable member having another portion engageable with said type character bearing members for moving said bearing members into contact with said record media and toward said platen for printing, said another portion of the rotatable member being engageable with said type character bearing members also for rotating said platen to advance said record media, said rotatable member being disengageable from said type character bearing members for permitting movement of said bearing members toward the non-printing position, and means for moving said type character bearing members toward said non-printing position, said rotatable member having a further portion engageable with said type character bearing members for repositioning said bearing members in said non-printing position.

12. In the printer of claim 11 wherein said platen member is an elongated member rotatable by engagement with said type character bearing members.

13. In the printer of claim 11 wherein said type character bearing members are elongated racks independently movable from the non-printing position by said rotatable member.

14. In the printer of claim 11 wherein said rotatable member is an elongated member having a toothed portion engageable with said type character bearing members.

15. In the printer of claim 11 wherein said type character bearing members are racks having type characters on one face thereof and a plurality of teeth on the opposite face for engagement by said rotatable member.

16. In the printer of claim 11 wherein said rotatable member includes a toothed portion on the circumference thereof for moving said members to the printing position.

17. In the printer of claim 11 wherein said type character bearing members include a plurality of teeth and said rotatable member includes a plurality of teeth engageable with the teeth of said bearing members for moving said bearing members to the printing position.

18. In the printer of claim 11 wherein said rotatable member includes a plurality of teeth for moving said type character bearing members to the printing position and having an extended tooth for moving said bearing members against said platen.

19. In the printer of claim 11 wherein said rotatable bearing member includes an enlarged cam portion engageable with said members for positioning said members in the non-printing position.

20. In the printer of claim 11 including magnetic means for latching said type character bearing members in the non-printing position.

* * * * *

UNITED STATES PATENT AND TRADEMARK OFFICE

CERTIFICATE OF CORRECTION

PATENT NO. : 4,308,795

DATED : January 5, 1982

INVENTOR(S) : David C. Wills, Raymond L. Lawter, Barry D. Briggs & Edward F. Sampson It is certified that error appears in the above—identified patent and that said Letters Patent is hereby corrected as shown below:

Column 8, line 39, "bearing" should be omitted.

Column 8, line 40, insert -- bearing -- before "members".

Column 8, line 40, insert -- bearing -- before "mem-".

Signed and Sealed this

*Sixth* Day of *April 1982*

[SEAL]

*Attest:*

GERALD J. MOSSINGHOFF

*Attesting Officer*

*Commissioner of Patents and Trademarks*